US008661566B1

(12) United States Patent
Garcia

(10) Patent No.: US 8,661,566 B1
(45) Date of Patent: Mar. 4, 2014

(54) REUSABLE ABBREVIATED MITTEN DEVICE

(76) Inventor: Carlos M. Garcia, Ft. Lauderdale, FL (US)

( * ) Notice: Subject to any disclaimer, the term of this patent is extended or adjusted under 35 U.S.C. 154(b) by 234 days.

(21) Appl. No.: 13/076,559

(22) Filed: Mar. 31, 2011

(51) Int. Cl.
*A41D 19/01* (2006.01)

(52) U.S. Cl.
USPC ..... 2/158

(58) Field of Classification Search
USPC ..... 2/16, 20, 21, 158, 159, 160, 161.1, 2/161.6, 161.7, 161.8, 163, 168; D2/610, D2/611, 612
See application file for complete search history.

(56) References Cited

U.S. PATENT DOCUMENTS

| | | | | | |
|---|---|---|---|---|---|
| 580,148 | A | * | 4/1897 | Staples | 38/95 |
| 590,347 | A | * | 9/1897 | Sylvestre | 2/20 |
| 993,662 | A | * | 5/1911 | Dueease | 401/7 |
| 1,416,001 | A | * | 5/1922 | Detwiler | 2/21 |
| 1,955,989 | A | * | 4/1934 | Uhri | 2/20 |
| 1,990,553 | A | * | 2/1935 | Hirsch et al. | 2/20 |
| 2,069,449 | A | * | 2/1937 | Jensen | 2/20 |
| D188,383 | S | * | 7/1960 | Gravnin | D22/149 |
| 3,345,646 | A | * | 10/1967 | McCann | 2/171 |
| 4,745,635 | A | * | 5/1988 | Kinnear | 2/161.6 |
| 4,791,682 | A | | 12/1988 | Herr et al. | |
| 4,918,755 | A | * | 4/1990 | Kinnear | 2/161.6 |
| 4,938,515 | A | * | 7/1990 | Fazio | 294/25 |
| 5,025,503 | A | | 6/1991 | O'Brien | |
| 5,265,785 | A | * | 11/1993 | Chudy | 224/666 |
| D368,330 | S | * | 3/1996 | Robinson | D29/119 |
| 5,649,336 | A | * | 7/1997 | Finch et al. | 15/104.94 |
| 5,785,222 | A | * | 7/1998 | Basso et al. | 224/555 |
| 6,032,294 | A | | 3/2000 | Dean | |
| 6,145,128 | A | * | 11/2000 | Suzuki | 2/21 |
| 6,532,597 | B2 | * | 3/2003 | Bignon et al. | 2/161.6 |
| 6,643,846 | B2 | * | 11/2003 | Turner-Antonsen | 2/161.6 |
| D504,544 | S | * | 4/2005 | Lee | D29/118 |
| 7,063,233 | B2 | * | 6/2006 | Jordan et al. | 221/197 |
| 7,117,536 | B2 | * | 10/2006 | Burnett et al. | 2/16 |
| 7,124,446 | B2 | * | 10/2006 | Demay et al. | 2/16 |
| 7,165,270 | B2 | * | 1/2007 | DeYoung et al. | 2/16 |
| D544,152 | S | * | 6/2007 | Lion et al. | D29/113 |
| D580,215 | S | * | 11/2008 | McCarthy et al. | D7/368 |
| 7,546,644 | B2 | * | 6/2009 | Bignon et al. | 2/161.6 |
| D634,898 | S | * | 3/2011 | Lion et al. | D29/119 |
| 8,132,692 | B2 | * | 3/2012 | Jordan | 221/197 |
| 2002/0116746 | A1 | * | 8/2002 | Williams | 2/161.6 |
| 2003/0131393 | A1 | * | 7/2003 | Votolato | 2/16 |
| 2006/0200892 | A1 | * | 9/2006 | Liang | 2/158 |
| 2007/0118963 | A1 | * | 5/2007 | Snyder | 2/158 |
| 2009/0100562 | A1 | * | 4/2009 | Liang | 2/20 |
| 2012/0216329 | A1 | * | 8/2012 | Dennis | 2/158 |

* cited by examiner

*Primary Examiner* — Alissa L Hoey

(57) ABSTRACT

The reusable abbreviated mitten system provides a rubberized mitten having an abbreviated mitten length such that the mitten reaches only to the base of the thumb of a user, a finger portion, a hand reinforcement cuff, a symmetrical thumb portion, an obround case having an open top, a closed bottom, and an inverted L clip disposed on one side of the case. The mitten provides for quick donning and doffing while saving considerably on materials and production costs to not only provide easy, quick, reusable use, but also to contribute to environmentalism and natural resource savings. The mitten is formed of elastic rubber and alternately non-elastic rubber.

1 Claim, 4 Drawing Sheets

REUSABLE ABBREVIATED MITTEN DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

A plethora of rubberized type gloves exist, with many being reusable. Most such reusable gloves, which may also include mittens, are full gloves and mittens whereby the devices fully cover hands and often wrists. In glove design, mittens are inherently beneficial regarding natural resources and material expenditures, as the surface area needed to cover a hand is reduced. Still, natural resources and production of full hand coverage may be wasteful. An abbreviated glove, which only essentially covers the fingers and thumb, and a part of the hand may therefore provide a significant reduction in waste as a contribution toward a global green effort. The present device provides this advantage, along with other advantages described herein.

FIELD OF THE INVENTION

The reusable abbreviated mitten device relates to reusable gloves and more especially to an abbreviated reusable mitten.

SUMMARY OF THE INVENTION

The general purpose of the reusable abbreviated mitten device, described subsequently in greater detail, is to provide a reusable abbreviated mitten device which has many novel features that result in an improved reusable abbreviated mitten device which is not anticipated, rendered obvious, suggested, or even implied by prior art, either alone or in combination thereof.

To attain this, the reusable abbreviated mitten device offers protection for a user's fingers, thumb, and across a user's hand at the base of the thumb. The device also provides an obround carry case with clip so that the mitten can be carried on various objects, such as an interior car door or the like wherein pocket edges and such are typically available. The carry case importantly has a case depth less than that of the mitten so that the mitten is easily obtained without typical mitten and glove encasement problems known to frequent users of such items. The obround case shape is important for easy accessibility of the mitten.

The mitten is importantly abbreviated for temporary, reusable use, without the full hand or hand and wrist coverage. This important feature accomplishes more than one goal. First, the mitten is easily donned and doffed, important for rapid, easy use. And, the savings in materials and production costs are significant. Cost savings provides for extremely low final sales price. Cost savings also makes a significant and favorable effort toward environmentalism, a very important feature of the device. Considering the number of reusable rubberized gloves in use daily across the globe, some for only seconds, for example, this is no small concern.

Another important feature of the mitten is the hand reinforcement. Many reusable gloves, for example, are torn during application due to lack of integrity when a user pulls at the glove in attempt to don. The hand reinforcement negates destruction of the mitten in donning and also provides sufficient integrity to guard against mitten malformation that might otherwise be experienced during the same donning procedure, such possible malformation being unfavorable to mitten use. Thus, the present mitten may be used several times prior to disposal.

An additional important feature is the design of the thumb portion. The symmetrical and relatively wide entry width of the thumb portion provides for easy donning of the mitten as well as omnidirectional use, availing either of a user's hands to the same mitten. Also, the symmetrical thumb portion narrows to an end width so that relatively effective thumb retention is possible, enabling reasonable mitten retention during right hand and alternate left hand use.

The mitten is provided as a right-hand mitten and alternately, as a left-hand mitten, in sizes from small to extra large and are also provided in rubberized material in an elastic form and in a non-elastic form. Mitten length dimensions are critical.

Thus has been broadly outlined the more important features of the improved reusable abbreviated mitten device so that the detailed description thereof that follows may be better understood and in order that the present contribution to the art may be better appreciated.

An object of the reusable abbreviated mitten device is to provide a reusable protection abbreviated glove.

An object of the reusable abbreviated mitten device is to be extremely conscious of waste of resources.

Another object of the reusable abbreviated mitten device is to be especially useful for use in fuel tank filling.

A further object of the reusable abbreviated mitten device is to provide easy glove application.

An added object of the reusable abbreviated mitten device is to provide easy glove removal.

And, an object of the reusable abbreviated mitten device is to ensure against excessive expansion at the hand reinforcement location.

A further object of the reusable abbreviated mitten device is to provide for either hand usage.

Yet another object of the reusable abbreviated mitten device is to provide for easy thumb entry for right hand use and alternately for left hand use.

Still another object of the reusable abbreviated mitten device is to provide for easy thumb removal.

And, an object of the reusable abbreviated mitten device is to provide readily accessible storage for the mitten.

Another object of the reusable abbreviated mitten device is to provide user choice in elasticity.

These together with additional objects, features and advantages of the improved reusable abbreviated mitten device will be readily apparent to those of ordinary skill in the art upon reading the following detailed description of presently preferred, but nonetheless illustrative, embodiments of the improved reusable abbreviated mitten device when taken in conjunction with the accompanying drawings.

DETAILED DESCRIPTION OF THE DRAWINGS

Figure 1:
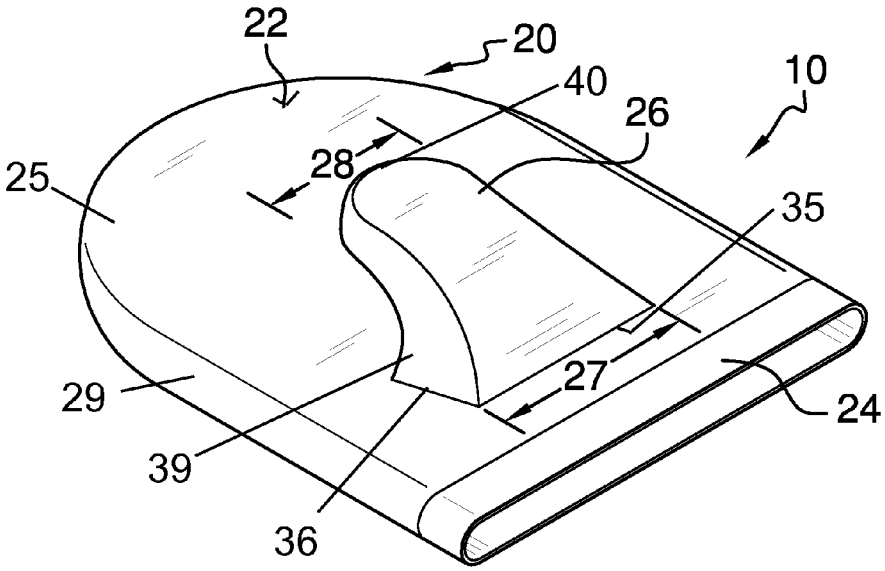
FIG. 1 is a perspective view.
Figure 2:
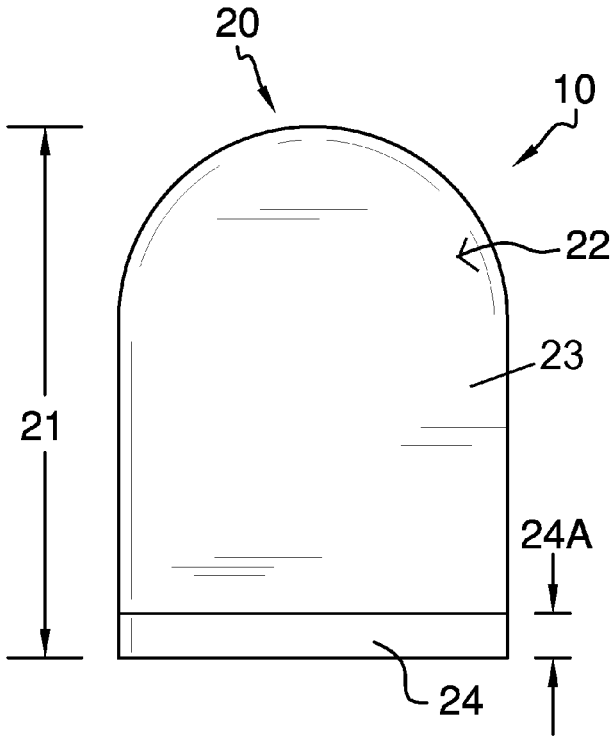
FIG. 2 is a plan view.

With reference now to the drawings, and in particular FIGS. 1 through 6 thereof, the principles and concepts of the reusable abbreviated mitten device generally designated by the reference number 10 will be described.

The abbreviated mitten 20 has a mitten length 21. The mitten length 21 is dependent upon mitten 20 sizing selected from a list consisting of sizes dependent upon small, medium, large, and extra large. The small size mitten length 21 is 4½ inches. The medium size mitten length 21 is 5¼ inches. The large size mitten length 21 is 6¼ inches. The extra large size mitten length 21 is 7 inches. The mitten lengths 21 are important in that the finger and thumb of a user's hand, along with the portion of the hand that reaches across the hand at the base of the thumb are all protected, yet the waste of materials and manufacturing are negated relative to producing, for example, a device 10 that exceeded these lengths. The mitten 20 is rubberized. The term "rubberized" as used herein includes materials that are coated or impregnated with rubber as well as materials that contain natural or synthetic rubber therein.

Figure 3:
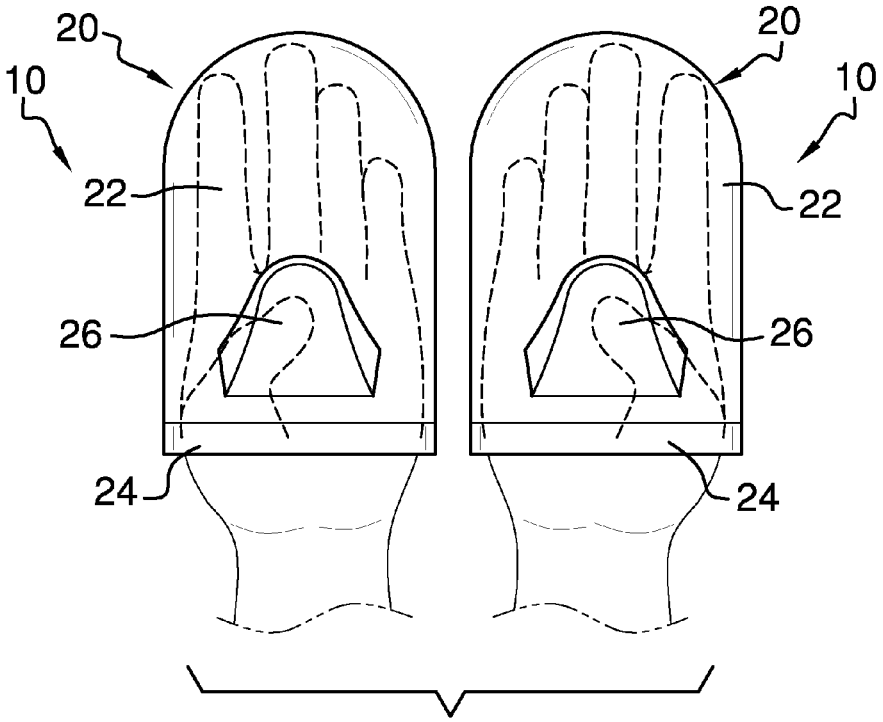
FIG. 3 is a plan view of a pair of the devices, applied.

Referring to FIG. 3, the mitten 20 further comprises a finger portion 22. The finger portion 22 is oriented for right hand use and alternately for left hand use.

The mitten 20 further comprises a hand reinforcement cuff 24 having a width 24A of about ½ inch. The mitten 20 further comprises the symmetrical thumb portion 26. The finger portion 22 includes a smooth semi-obround top surface 23, a smooth semi-obround bottom surface 25, and a continuous side surface 29 conjoining the top surface 23 and the bottom surface 25. The thumb portion 26 includes an entry side 35 and a continuous side wall 36. The side wall 36 includes a pair of substantially wedge-shaped bottom portions 39 attached to the bottom surface 25 and a central strip portion 40 affixed between the bottom portions 39. The wedge-shaped bottom portions 39 and the central strip portion 40 of the side wall 36 permit the thumb portion 26 to interchangeably accommodate the thumb on either the user's right hand or left hand.

Referring again to FIG. 1, the thumb portion 26 importantly has an entry width 27 of about 2 inches. This entry width 27 enables ease of entry of the thumb of either hand of a user. Also important is the thumb portion 26 end width 28 of about 1 inch. This end width 28 enables reasonable retention of a user's thumb while still permitting chosen escape from the mitten 20.

Figure 4:
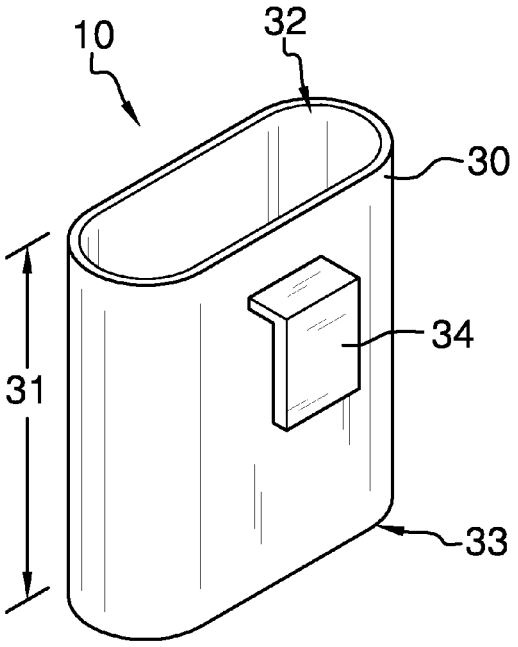
FIG. 4 is a perspective view of the case.

Referring to FIG. 4, the device 10 further comprises the obround case 30 having an open top 32 and a closed bottom 33. The inverted L clip 34 is disposed on one side of the case 30. The case 30 further comprises a case depth 31 of about 4 inches. The case depth 31 of about 4 inches is important in that any size of the mitten 20 may be removably retained and yet remain extremely accessible to a user. The obround shape makes a further important statement to mitten 20 availability.

Figure 5:
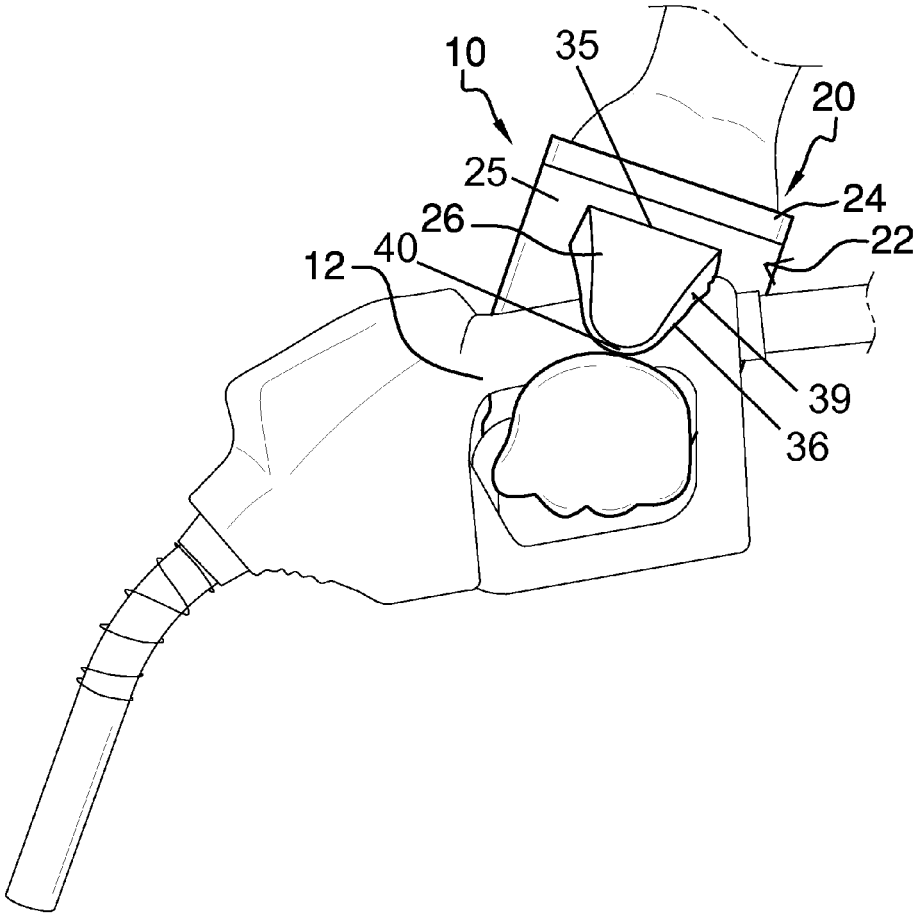
FIG. 5 is a perspective in-use view.

Referring to FIG. 5, the mitten 20 is used to grasp an existing gas pump handle 12 while negating any contamination of a user's hand.

Figure 6:
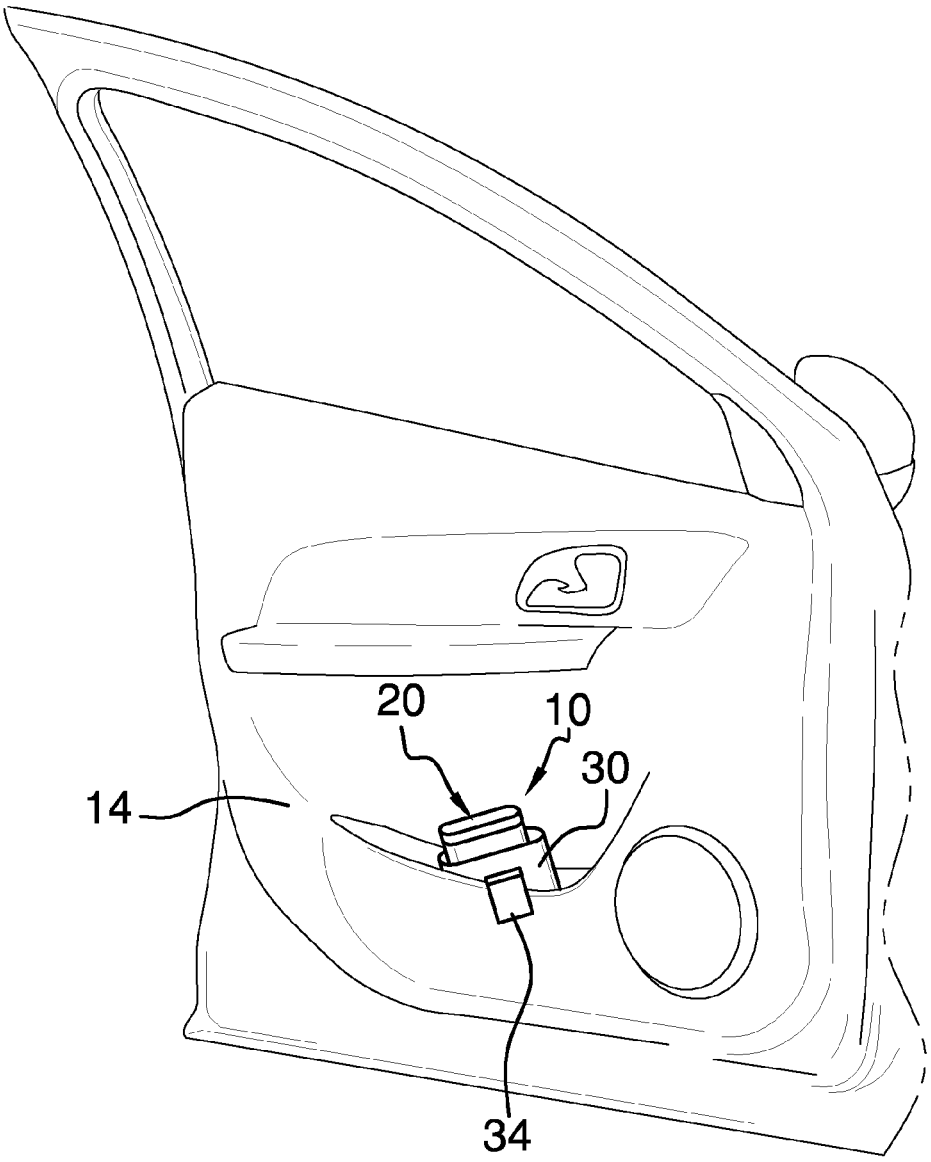
FIG. 6 is a perspective view of the device clipped to an existing interior car door.

Referring to FIG. 6, the obround case 30 is removably attached within an existing interior car door 14. The availability of mitten 20 from the case 30 is illustrated.

Directional terms such as front, back, in, out, and the like may have been used in the description. These terms are applicable to the embodiments shown and described in conjunction with the drawings. These terms are merely used for the purpose of description in connection with the drawings and do not necessarily apply to the position in which the reusable abbreviated mitten device may be used.

What is claimed is:

1. A reusable abbreviated mitten system consisting of:

a rubberized, elastic mitten having a mitten length, the length selected from a group consisting of 4½ inches, 5¼ inches, 6¼ inches, and 7 inches, the mitten further comprising:

a finger portion comprising a smooth semi-obround top surface, a smooth semi-obround bottom surface, and a continuous side surface conjoining the top surface and the bottom surface;

a hand reinforcement cuff having a width of about ½ inch;

a symmetrical thumb portion, the thumb portion comprising an entry side and a continuous side wall, the side wall comprising a pair of substantially wedge-shaped bottom portions attached to the bottom surface and a rectangular central portion disposed between the bottom portions, the thumb portion having an entry width of about 2 inches and an end width of about 1 inch;

an obround case having an open top, a closed bottom and a case depth of about 4 inches;

an inverted L clip disposed on a one side of the case;

wherein the finger portion is configured to accommodate the fingers of a right hand and alternately of a left hand.

* * * * *